US006300305B1

(12) United States Patent
Huff et al.

(10) Patent No.: US 6,300,305 B1
(45) Date of Patent: Oct. 9, 2001

(54) DETERGENCY BOOSTERS FOR DETERGENTS

(75) Inventors: Juergen Huff, Bissersheim; Ulrich Steuerle, Heidelberg; Hubert Meixner; Beate Ehle, both of Ludwigshafen; Wolfgang Paulus, Mainz; Juergen Alfred Lux, Niederkirchen; Lukas Haeussling, Bad Duerkheim, all of (DE)

(73) Assignee: BASF Aktiengesellschaft, Ludwigshafen (DE)

( * ) Notice: Subject to any disclaimer, the term of this patent is extended or adjusted under 35 U.S.C. 154(b) by 0 days.

(21) Appl. No.: 09/562,940

(22) Filed: May 2, 2000

Related U.S. Application Data

(62) Division of application No. 09/155,412, filed as application No. PCT/EP97/01512 on Mar. 26, 1996, now Pat. No. 6,180,590.

(30) Foreign Application Priority Data

Mar. 26, 1996 (DE) ..... 196 11 977

(51) Int. Cl.[7] ..... C11D 3/30; C11D 3/37

(52) U.S. Cl. ..... 510/475; 510/499

(58) Field of Search ..... 510/475, 499

(56) References Cited

FOREIGN PATENT DOCUMENTS

17813/95 * 12/1995 (AU) .
3-8426 * 1/1991 (JP) .

* cited by examiner

*Primary Examiner*—John Hardee
(74) *Attorney, Agent, or Firm*—Oblon, Spivak, McClelland, Maier & Neustadt, P.C.

(57) ABSTRACT

The use of an amine with an average $pK_A$ of from 1 to 14 as detergency booster, preferably in textile detergents, especially in color detergents, and detergent formulations containing these amines.

22 Claims, No Drawings

DETERGENCY BOOSTERS FOR DETERGENTS

This application is a Division of application Ser. No. 09/155,412, Filed on Oct. 28, 1998, U.S. Pat. No. 6,180,590, WHICH WAS FILED ORIGINALLY AS INTERNATIONAL PCT/EP97/01512, FILED Mar. 26, 1996.

BACKGROUND OF THE INVENTION

1. Field of the Invention

The invention relates to the use of amines and their reaction products and condensation products with acids as detergency boosters, and to detergents containing these.

2. Description of the Background

DE-A1-31 24 210 describes liquid detergents with additives to prevent dye transfer. The detergent in this case contains nonionic or zwitterionic surfactants in combination with polyethylene, amines, polyamines, polyamine-amides or polyacrylamides, which counteract dye transfer from colored textiles to white or pale-colored textiles when they are laundered together. The polyamine-amides are obtainable by condensation of polybasic acids such as dibasic saturated aliphatic $C_{3-8}$ acids and polyamines. The polymers are described as soluble in water but not identified in detail.

DE-A1-32 11 532 describes compositions for washing and bleaching, in a non-dye-damaging manner, textiles. The detergents comprise nonionic surfactants, with or without zwitterionic surfactants, bleaching compounds, and additives to protect dyed textiles from color changes, which are polyethyleneimines, polyamines, polyamine-amides or polyacrylamides. These compounds are described as soluble in water but not specified in detail.

DE-A-1 922 450 describes detergents and cleaners which comprise antiredeposition agents to prevent resorption on the cleaned surfaces of dirt which has been removed.

Polyamides which can be prepared from polyetheyleneimines with an average molecular weight of from 300 to 6000 and di- and tricarboxylic acids are used as antiredeposition agents. Reaction products with diglycolic acid, thiodiglycolic acid, aminodiacetic acid and nitrilotriacetic acid are also mentioned.

DE-A-2 165 900 describes detergents with a content of additives which prevent redeposition. The reaction product of a polyethyleneimine with a molecular weight of from 430 to 10,000 with $C_{3-18}$-alkyl glycidyl ethers, which can furthermore be reacted with ethylene oxide, is used as antiredeposition agent.

EP-A3-0 411 436 describes the use of 2-hydroxy-3-aminopropionic acid derivatives as complexing agents, bleach stabilizers and builders in detergents and cleaners. The propionic acid derivatives may have, inter alia, polyvinylamine residues or polyethyleneimine residues.

The use of rapeseed oil fatty amine as detergency booster to remove fat particle soil is described in P. F. Kikolsi, Comun. Jorn. Com. Esp. Deterg. 23 (1992) 392-333.

WO 95/33035 discloses detergent compositions which comprise oleoyl sarcosinate and a surfactant amine and are effective in particular for removing fatty or oily soilings. Primary and tertiary amines are preferably used as amines. Secondary amines with two long-chain alkyl radicals are also disclosed.

It is an object of the present invention to provide detergency boosters for detergents.

It is another object to provide detergency boosters to improve removal of dirt, in particular for stains which comprise a combination of fatty or oily and pigment-like or particulate constituents.

It is another object to provide detergents comprising detergency boosters.

It is another object to provide detergency boosters for reduced phosphate or phosphate-free detergents.

We have found that these objects are achieved by using amines as described in the claims, and by detergents as described in the claims.

As described above, the use of certain polyethyleneimines, polyamines and polyamides as antiredeposition agents or agents to prevent color transfer are known in the prior art.

In addition, certain polyalkylenepolyamines modified with ethylene oxide and/or fatty acid residues have been used as detergent auxiliaries.

It has been found, surprisingly, that amines and polyalkylenepolyamines which are not modified with ethylene oxide, with or without fatty acid residues, have a detergency-boosting action. Additions of small amounts of unmodified or only partially modified amines or polyalkylenepolyamines to modern detergent and cleaner formulations distinctly improve their wash efficiency, especially with regard to problematic stains which comprise a combination of fatty or oily and pigment-like or particulate constituents. The amines according to the invention are particularly advantageously employed as detergency boosters in color textile detergents. It is possible by use of the amines according to the invention distinctly to improve the soil removal capacity of color detergents, which is more limited in comparison with heavy duty detergents.

The amines according to the invention are particularly preferably used as detergency boosters in respect of oil/particle or fat/particle stains on cotton and cotton-containing blended fabrics. Compared with known detergency boosters, the detergency boosters according to the invention have the following advantages:

- greater efficacy on use of the same amount,
- improvement in the soil removal capacity of colored textile detergents,
- improvement in the soil removal capacity for oil/particle or fat/particle stains on cotton-containing fabrics.

Examples of stains of these types are used engine oil, lipstick, makeup, shoe cream, clay/oil mixture etc.

Amines

The amines used according to the invention as detergency boosters, preferably in colored textile detergents having an average $pK_A$ of from 1 to 14, preferably 2 to 13, in particular 5 to 12.5. In this connection, the $pK_A$ is that of the acid corresponding to the amine, i.e. of the protonated amine, and equals 14-$pK_B$ of the amine. The average $pK_A$ is defined as half the total acid used on titration of the amine.

In one embodiment of the invention, the amine is selected from amines of the general formula (I)

$$RR'N—[—(CR^1R^2)_x—NR^3—]_n—[—(CR^4R^5)_y—NR^6—NR]_b—R'' \quad (I)$$

where the radicals R, R' and R", $R^1$, $R^2$, $R^4$ and $R^5$ are, independently of one another, hydrogen atoms, linear or branched-chain $C_{1-20}$-alkyl, -alkoxy, -hydroxyalkyl, -(alkyl) carboxy or -alkylamino radicals, $C_{2-20}$-alkenyl radical or $C_{6-20}$-aryl, -aryloxy, -hydroxyaryl, -arylcarboxy or -arylamino radicals, which are unsubstitued or can be further substituted, while the radicals $R^3$ and $R^6$ are, independently of one another, hydrogen atoms, linear or branched-chain $C_{1-20}$-alkyl radicals, $C_{6-20}$-aryl radicals, which are unsubstituted or substituted, or radicals $[(CR^7R^8)_z—NR^9]_c—R^{10}$, where the radicals $R^7$, $R^8$, $R^9$ and $R^{10}$ are, independently of one another, defined as above for R, R', R", $R^1$, $R^2$, $R^4$ and $R^5$, or are carboxymethyl, carboxyethyl, phosphonomethyl or carboxamidoethyl radicals, x, y and z have, independently of one another, a value of 2, 3 or 4, and a, b and c have, independently of one another, an integral value of 0–300.

In the above amines, preferably from 5 to 100%, in particular 10 to 95%, of the nitrogen atoms are in the form of primary or secondary amino groups.

In one embodiment of the invention, the above amines have a number average molecular weight of from 80 to 150,000, preferably 100 top 50,000, particularly preferably 110 to 10,000, especially 129 to 5000.

It has been found according to the invention that the efficacy of the amines as detergency boosters is significantly better at lower molecular weights (up to a number average of about 2500) than that of amines or polyalkylenepolyamines with higher molecular weights.

The amines employed according to the invention ought preferably to have a molecular geometry which makes it possible for them to penetrate into cavities in textile fabrics during laundering and to displace, and thus detach, dirt located therein.

The amine or polyalkylenepolyamine of the general formula (I) can be a block polymer or block copolymer or, in one embodiment of the invention, a polymer with randomly distributed blocks or an overall randomly distributed polymer.

Likewise according to the invention are polymers which comprise repeating unit corresponding to the following formula:

$$—[CH_2—CH(NH_2)]—$$

By this are meant, in particular, oligo/polyvinylformamides and copolymers of vinylformamide whose formamide groups are at least partly, preferably 5–100 mol %, converted into amino groups by hydrolysis. Oligo/polyvinylformamides whose formamide groups are 20–100 mol %, in particular 40–100 mol %, converted by hydrolysis into amino groups are preferably employed. The hydrolysis can take place both in alkaline and in acidic medium.

In one embodiment of the invention, these polymers have a number average molecular weight of from 80 to 150,000, preferably 100 to 50,000, particularly preferably 110 to 10,000, especially 129 to 5000.

The amines and polyamines used according to the invention are prepared by known processes.

In one embodiment of the invention, the amine is selected from amines of the general formula (II)

$$(R^1R^1(N—X—N)R^1R^1) \quad (II)$$

where the radicals $R^1$ are hydrogen atoms or $(R^2R^2)N—(CH_2)_n$- radicals, the radicals $R^2$ are hydrogen atoms or $(R^3R^3)N—(CH_2)_n$-radicals, the radicals $R^3$ are hydrogen atoms or $(R^4R^4)N—(CH_2)_n$-radicals, the radicals $R^4$ are hydrogen atoms or $(R^5R^5)N—(CH_2)_n$-radicals, the radicals $R^5$ are hydrogen atoms or $(R^6R^6)N-(CH_2)_n$-radicals, the radicals $R^6$ are hydrogen atoms, n has a value of 2, 3, or 4, and the radical X is one of the radicals

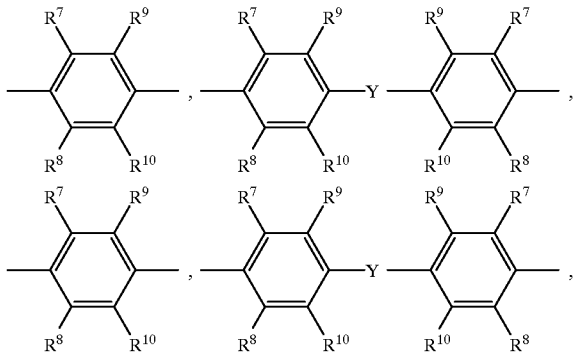

$—(CH_2)_n—$, $—(CH_2)_3—NR^{11}—(CH_2)_3—$, $C_{2-20}$-alkylene, the radical Y is an oxygen atom, a $CR^7R^9C{=}O$ radical or $SO_2$, n has an integral value of 2–20, and k have, independently of one another, an integral value of 2–6, m has an integral value of 1–40, the radicals $R^7$, $R^{8d}$, $R^9$ and $R^{10}$ are, independently of one another, hydrogen atoms or $C_{1-6}$-alkyl radicals, and the radical $R^{11}$ is $C_{1-20}$-alkyl, $C_{2-20}$-dialkylamino-$C_{2-10}$- alkyl, $C_{1-10}$-alkoxy-$C_{2-10}$-alkyl, $C_{2-20}$-hydroxyalkyl, $C_{3-12}$-cycloalkyl, $C_{4-20}$-cycloalkylalkyl, $C_{2-20}$-alkenyl, $C_{4-30}$-dialkylaminoalkenyl, $C_{3-30}$-alkoxyalkenyl, $C_{3-20}$-hydroxyalkenyl, $C_{5-20}$-cycloalkylalkenyl, an unsubstituted or mono- to penta-$C_{1-8}$-alkyl-, $C_{2-8}$-dialkylamino-, $C_{1-8}$-alkoxy-, hydroxyl-, $C_{3-8}$- cycloalkyl- or $C_{4-12}$-cycloalkylalkyl-substituted aryl radical or $C_{7-20}$-aralkyl radical, or two radicals $R^{11}$ together afford an alkylene chain which is uninterrupted or interrupted by nitrogen or oxygen, such as ethylene oxide, propylene oxide, butylene oxide and $—CH_2—CH(CH_3)—O—$ or polyisobutylene with from 1 to 100 isobutylene units, where 5–100% of the nitrogen atoms are in the form of primary or secondary amino groups.

The amines of the general formula (II) are preferably prepared by the process described in German Patent Application P 44 40 551.0-44.

They are preferably prepared from diamines of the general formula $NH_2—(CH_2)_n—NH_2$ where n has an integral value of from 2 to 20. Examples of suitable diamines of this type are 1,2-ethylenediamine, 1,3-propylenediamine, 1,4-butylenediamine and 1,6-hexamethylenediamine. Also preferably employed are primary tetraaminoalkylalkylenediamines such as N,N,N',N'-tetraaminopropyl-1,2-ethylenediamine, N,N,N',N'-tetraaminopropyl-1,3-propylenediamine, N,N,N',N'-tetraaminopropyl-1,4-butylenediamine and N,N,N',N'-tetraaminopropyl-1,6-hexamethylenediamine.

The radicals $R^7$, $R^8$, $R^9$ and $R^{10}$ in the general formula II are $C_{1-6}$-alkyl radicals, preferably $C_{1-3}$-alkyl radicals, such as methyl, ethyl, n-propyl and isopropyl, particularly preferably methyl and ethyl, especially methyl, or preferably hydrogen, with the radicals $R^7$ and $R^8$, and $R^9$ and $R^{10}$, preferably being identical.

Examples of radicals $R^{11}$ according to the invention are $C_{1-20}$-alkyl radicals, preferably $C_{1-12}$-alkyl radicals, such as methyl, ethyl, n-propyl, isopropyl, n-butyl, isobutyl, sec-butyl, tert-butyl, n-pentyl, isopentyl, sec-pentyl, neopentyl, 1,2-dimethylpropyl, n-hexyl, isohexyl, sec-hexyl, n-heptyl, isoheptyl, n-octyl, isooctyl, n-nonyl, isononyl, n-decyl, isodecyl, n-undecyl, isoundecyl, n-dodecyl and isododecyl radicals, particularly preferably $C_{1-4}$-alkyl radicals such as methyl, ethyl, n-propyl, isopropyl, n-butyl, isobutyl, sec-butyl and tert-butyl radicals, aryl radicals such as phenyl, 1-naphthyl and 2-naphthyl radicals, preferably phenyl radicals, $C_{7-20}$-aralkyl radicals, preferably $C_{7-12}$-phenylalkyl radicals, such as benzyl, 1-phenethyl, 2-phenethyl, 1-phenylpropyl, 2-phenylpropyl, 3-phenylpropyl, 1-phenybutyl, 2-phenylbutyl, 3-phenylbutyl and 4-phenylbutyl radicals, particularly preferably benzyl, 1-phenethyl and 2-phenethyl radicals, $C_{7-20}$-alkylaryl radicals, preferably $C_{7-12}$-alkylphenyl radicals, such as 2-methylphenyl, 2-methylphenyl, 4-methylphenyl, 2,4-dimethylphenyl, 2,5-dimethylphenyl, 2,6-dimethylphenyl, 3,4-dimethylphenyl, 3,5-dimethylphenyl, 2,3,4-trimethylphenyl, 3,4,5-trimethylphenyl, 2,3,6-trimethylphenyl, 2,4,6-trimethylphenyl, 2-ethylphenyl, 3-ethylphenyl, 4-ethylphenyl, 2,-i-propylphenyl, 3-n-propylphenyl and 4-n-propylphenyl radicals or polyisobutylene radicals with 1–100, preferably 1–70, particularly preferably 1–50, isobutylene units.

Preferred examples of amines (II) according to the invention, which are also referred to as dendrimeric amines, and their precursors, are N,N,N',N'-tetraaminopropylethylenediaine, referred to as N6-amine hereinafter, and the dendrimeric amines which can be prepared therefrom by aminopropylation and are identified by the number of their N atoms, such as N14-, N30- , N62- and N128-amines of BASF AG. These amines have an ethylenediamine basic framework whose hydrogen atoms on the nitrogen are replaced by amino(n-propyl) radicals. The terminal amino groups in this case can in turn be substituted by appropriate aminopropyl groups (N14-amine) etc. Processes for preparing these amines are described in German Patent Application P 44 40 551.0-44, starting from ethylenediamine. Likewise preferred examples of these amines according to the invention are corresponding N-amines as described in WO 93/14147, which are prepared starting from butylenediamine instead of ethylenediamine as above. Amines of this type are prepared and marketed by DSM.

Preferred amines of the general formula (I) are furthermore polyethyleneimines such as polyethyleneimine homopolymers with a degree of polymerization n of 5, 6, 10, 20, 35 and 100. These polyethyleneimine homopolymers can be prepared either containing water or anhydrous or be dehydrated. The synthesis of corresponding polyethyleneimines is described in the examples.

The polyethyleneimines may furthermore be partially modified, for example in one embodiment of the invention rendered hydrophobic with benzoic acid.

Amines of the general formula (I) preferred according to the invention are furthermore polyamines of the following formula $$RR'N—[—(CH_2)_m—NR'']_x—R'''$$

where the radicals R, R' or R'' are, independently of one another, hydrogen atoms, $C_{1-20}$-alkyl radicals, $C_{2-20}$-alkenyl radicals or $C_{6-20}$-aryl radicals, the radical R''' is a hydrogen atom or a $—(CH_2)_o—[NH—(CH_2)_m—]_p—NH_2$ radical or a hydroxyalkyl or alkoxy radical, where x has a integral value of 1–10, m has an integral value of 2–4, o has an integral value of 2–4, and p has an integral value of 0–10.

Particularly preferred amines of the general formula (I) are the following $$H_2N—[—(CH_2)_mNH]_x—H$$

where m has the value 2, 3 or 4 and x has an integral value of 1–10, $$RR'N—[—(CH_2)_m—NH]_x—H$$

where the radicals R and R' are, independently of one another, $C_{1-20}$-alkyl radicals, $C_{2-20}$-alkenyl radicals or $C_{-6-20}$-aryl radicals, m has the value 2, 3, or 4, and x has an integral value of 1–10

$$H_2N—(CH_2)_4—NR—(CH_2)_4—NH_2$$

where the radical R is a hydrogen atom or a $C_{1-20}$-alkyl radical, $C_{2-20}$-alkenyl radical or $C_{6-20}$-aryl radical, $$H_2N—[—(CH_2)_mNH]_x—(CH_2)_o—[NH—(CH_2)_m—]_p—NH_2$$

where m has the value 2, 3 or 4, o has the value 2, 3 or 4, x has an integral value of 0–10, p has an integral value of 0–10, and the total of n and p≧1.

Particularly preferred amines are aliphatic long-chain N-alkyl-N-aminopropyl-amines (R=H, R'=$C_{12}$–$C_{18}$, x=1, m=3), which are marketed by Akzo under the proprietory name Duomeen® (for example Duomeen® C=N-coconut fatty alkyl-N-aminopropylamine), N,N-dialkylaminopropylamines (R,R'=$C_1$–$C_{10}$ alk(en)yl, x=1, m=3) such as N,N-dibutylaminopropylamine, N,N'-bisaminopropylalkylenediamines (m=3, o=$C_4$–$C_{20}$, x=p=1) such as N,N'-bisaminopropyl-1,6-hexamethylenediamine or N,N'-bisaminopropyl-1,8-octamethylenediamine.

In particular embodiment, primary or, particularly preferably, secondary amines of the general formula $R^1R^2NH$ are used according to the invention as detergency boosters, where the radicals $R^1$ and $R^2$ are, independently of one another, $C_{1-20}$-, preferably $C_{1-15}$-, hydrocarbyl radicals which may together form a cyclic radical, or salts thereof, and $R^2$ can also be H, except rapeseed oil fatty amine.

In this case preferably the radical $R^1$ is a $C_{6-14}$-hydrocarbyl radical and the radical $R^2$ is H or a $C_{1-5}$-hydrocarbyl radical, preferably H or a methyl radical.

The term "hydrocarbyl" which is used in the description and the claims describes radicals which are based on hydrocarbons with the stated number of carbon atoms and which may be pure hydrocarbon radicals but may also have substitutents. Examples of radicals embraced by the term "hydrocarbyl radicals" are indicated below.

The radicals $R^1$ and $R^2$ can, according to the invention, be $C_{1-20}$-alkyl radicals, particularly preferably $C_{1-10}$-alkyl radicals, which can be straight-chain or branched. The radicals $R^1$ and $R^2$ can be $C_{2-20}$-, particularly preferably $C_{2-10}$-, alkenyl radicals, which can be straight-chain or branched. The radicals can also be $C_{5-18}$-cycloalkyl radicals which may have branches, a ring structure composed of five to eight carbon atoms being possible. The radicals $R^1$ and $R^2$ may furthermore be $C_{7-18}$-aralkyl radicals, in which case an aromatic radical is linked via an alkyl group to the amine nitrogen atom. The radicals can also be $C_{7-18}$-heteroalkyl radicals or $C_{6-18}$-aryl radicals or $C_{6-18}$-hetaryl radicals, with in the case of the latter compounds an aromatic radical being linked directly to the amine nitrogen atom.

The carbon chains in the radicals $R^1$ and $R^2$ may furthermore be interrupted by oxygen atoms, imino groups, $C_{1-4}$-alkylimino radicals, iminocarbonyl radicals, oxycarbonyl radicals or carbonyl radicals.

The radicals $R^1$ and $R^2$ may furthermore together form a cyclic radical which produces together with the amine nitrogen atom a cyclic structure. In this case, the ring of the cyclic radical is preferably formed of 3 to 8 carbon atoms which can in turn be substituted as described above. It is also possible for other hetero atoms such as oxygen or nitrogen atoms to be present in the ring structure.

In a preferred embodiment, the radicals $R^1$ and $R^2$ are hydrophobic radicals. These radicals are preferably unbranched or branched $C_{1-20}$-alkyl radicals, particularly preferably $C_{1-10}$-alkyl radicals, $C_{2-20}$-alkenyl radicals, particularly preferably $C_{2-10}$-alkenyl radicals, $C_{5-18}$-cycloalkyl radicals, $C_{7-18}$-aralkyl radicals or $C_{7-18}$-hetaralkyl radicals or $C_{6-18}$-aryl radicals or $C_{6-18}$-hetaryl radicals.

The secondary amines are preferably not symmetrically substituted. This means that the radicals $R^1$ and $R^2$ are different from one another, it being possible for each of the radicals $R^1$ and $R^2$ to have one of the structures described above.

Examples of preferred amines are octylamine, decylamine, dodecylamine, tetradecylamine, cocoylamine, oleylamine, N-hydroxyethyloctylamine, N-hydroxyethylcocoylamine, N-hydroxyethyloleylamine, N-hexyl-N-methylamine, N-heptyl-N-methylamine, N-octyl-N-methylamine, N-nonyl-N-methylamine, N-decyl-N-methylamine, N-dodecyl-N-methylamine, N-tridecyl-N-methylamine, N-tetradecyl-N-methylamine, N-benzyl-N-methylamine, N-phenylethyl-N-methylamine, N-phenylpropyl-N-methylamine, each of which can have linear or branched hydrocarbon radicals, and the corresponding N-alkyl-N-ethylamines, N-alkyl-N-propylamines, N-alkyl-N-isopropylamines, N-alkyl-N-butylamines and N-alkyl-N-isobutylamines, in which the methyl radical is replaced by an ethyl, propyl, isopropyl, butyl or isobutyl radical.

The preparation of the primary or secondary amines used according to the invention is known. It can take place, for example, by reductive amination of aldehydes or by amination of nitriles.

Carboxylic acids

The amines listed above, especially the polyalkylenepolyamines of the formulae (I) and (II), can be employed alone in detergents and cleaners.

However, in a preferred embodiment, they are employed mixed with at least one di-/tri-/oligo- and polycarboxylic acid or an alkali metal salt, alkaline earth metal salt or ammonium salt thereof.

In a particularly preferred embodiment, they are employed as reaction products with the carboxylic acids.

By "reaction products", "reactive" etc. is meant according to the invention a product of a reaction between amine and carboxylic acid in which there may be a covalent, ionic or hydrogen bond between amine and carboxylic acid. An ionic bond is present, for example, on salt formation, and a covalent bond is present on condensation to give a carboxamide. Mixtures of condensation products with salt-like products are preferred. The mixtures of amine and carboxylic acid according to the invention can also be partly in salt form and partly in condensed form, as well as partly in free form, in one embodiment of the invention.

The carboxylic acid has the general formula (III) according to the invention $$A(COOH)_p \qquad \text{(III)}$$

where p has the value 2, 3 or 4, and the radical A is a radical which has p free valences to which the p carboxyl groups are bonded, selected from $C_1$–$C_{20}$-alkyl radicals, $C_2$–$C_{20}$-alkenyl radicals, $C_3$–$C_{20}$-cycloalkyl radicals, $C_6$–$C_{20}$-aryl radicals, -hetaryl radicals, imino radicals, oxy radicals, which can be linear or branched-chain and may have amino groups.

Examples of dicarboxylic acids which are used in one embodiment of the invention and in which the radical A is an alkyl radical are oxalic acid, malonic acid, succinic acid, glutaric acid, adipic acid, pimelic acid, suberic acid, azelaic acid and sebacic acid.

Examples of dicarboxylic acids in which the radical A is an alkenyl radical are maleic acid, fumaric acid and glutaconic acid.

Examples of dicarboxylic acids in which the radical A is an aryl or hetaryl radical are phthalic acid, isophthalic acid, sulfoisophthalic acid, terephthalic acid, 2,3-pyridinedicarboxylic acid, pyridinedicarboxylic acid (2,3-2,6).

Further examples of dicarboxylic acids which can be used according to the invention are diglycolic acid, thiodiglycolic acid, thiodipropionic acid, azodicarboxylic acid, oxomalonic acid, dimethylmalonic acid, methylmalonic acid, tartaric acid, sulphosuccinic acid, epoxysuccinic acid, iminosuccinic acid, acetylsuccinic acid, acetylenedicarboxylic acid, malic acid, itaconic acid or oxoglutaric acid.

Another example of a mixture of succinic acid, glutaric acid and adipic acid is Sokalan®DCS marketed by BASF AG.

In one embodiment of the invention, the carboxylic acid is a tricarboxylic acid.

Examples of tricarboxylic acids in which the radical A is an alkyl radical are citric acid, tricarballylic acid and methanetricarboxylic acid.

An example of a tricarboxylic acid in which the radical A is a cycloalkyl radical is cyclohexanetricarboxylic acid.

An example according to the invention of a tricarboxylic acid in which the radical A is an aryl radical is trimesic acid.

In one embodiment of the invention, the carboxylic acid is a tetracarboxylic acid. An example of a tetracarboxylic acid in which the radical A is an alkyl radical is butanetetracarboxylic acid.

An example of a tetracarboxylic acid in which the radical A is a cycloalkyl radical is cyclohexanetetracarboxylic acid.

It is furthermore possible to employ as carboxylic acids according to the invention amino carboxylic acids which have at lest two carboxyl groups. It is likewise possible to use condensation products of these amino carboxylic acids. Examples of suitable amino carboxylic acids are iminodiacetic acid, nitrilotriacetic acid, ethylenediaminetetraacetic acid, alkylglycinediacetic acids, aspartic acid and polyaspartic acid.

In one embodiment of the invention, the carboxylic acid can be an oligo- or polycarboxylic acid.

Examples therefore oligomers of maleic anhydride and homopolymers of acrylic acid or methacrylic acid, copolymers of acrylic acid, methacrylic acid and maleic anhydride with isobutene, polyisobutene, ethylene, alpha-olefins such as $C_{20-24}$-olefin, or styrene, acrylonitrile, and ethylenically unsaturated carboxylic acids.

It is likewise possible to use homo- or copolymers of acrylic and methacrylic acid derivatives such as methyl acrylate, ethyl acrylate, butyl acrylate, isobutyl acrylate, lauryl acrylate, tert-butyl acrylate, 2-hexyl acrylate, dimethylaminoethyl acrylate, diethylaminoethyl acrylate, hydroxyethyl acrylate, hydroxyethyl methacrylate.

Examples of industrially obtainable oligo/polycarboxylic acids are the acids marketed by BASF AG under the proprietory names Sokalan CP® and Sokalan PA®.

It is likewise possible to use oxidized carbohydrates, such as oxidized starch, as polycarboxylic acids.

The above carboxylic acids can be employed singly or in a mixture of two or more of these carboxylic acids. It is likewise possible to employ the carboxylic acids in the form of their conventional salts, especially the alkali metal salts.

In one embodiment of the invention, the ratio of amine to carboxylic acids is 0.001:1–1:0.001 (molar ratio).

In a preferred embodiment of the invention, the amines are reacted or condensed with the carboxylic acids in the ratio 1:(20–0.005).

Preferred amines which are used are tetraaminopropylalkylenediamines in which the alkylene radical has 2, 3 or 4 carbon atoms, and dendrimeric amines prepared therefrom, as well as tetraethylenepentamine and polyethyleneimine homopolymers with a degree of polymerization not exceeding 35.

Carboxylic acids which are preferably employed are succinic acid, glutaric acid, adipic acid, Sokalan PA 80S®, Sokalan CP 10S®, Sokalan CP 12S®, Sokalan DCS®, citric acid and terephthalic acid.

In a preferred embodiment, these preferred amines and carboxylic acids are reacted or condensed.

It is moreover possible to vary the ratio of primary and secondary amine groups, which are bound as ammonium salt, to the primary and secondary amine groups which are converted into the particular amide from depending on the choice of the reaction conditions.

The invention also relates to condensation products and reaction products of tetraaminopropylalkylenediamine and at least one of the carboxylic acids listed above, preferably terephthalic acid, glutaric acid, succinic acid, adipic acid, citric acid or a mixture thereof, where the alkylene radical in the tetraaminopropopylalkylenediamine has 2–20 carbon atoms, preferably 2–4 carbon atoms and is unsubstituted or substituted.

Detergent formulations

It has been found that the addition of small amounts of the amines according to the invention, especially polyalkylenepolyamines, preferably combined with the carboxylic acids according to the invention, to a modern color or heavy duty detergent formulation distinctly improves its soil-release properties. In this case these compounds act as detergency boosters.

The invention thus also relates to detergents comprising at least one surfactant and at least one amine selected from amines (a1), (a2) and (a3) of the general formulae described above, with or without at least one of the carboxylic acids indicated in claims 4 or 5, with or without other conventional ingredients.

In one embodiment of the invention, the detergent comprises at least one surfactant and at least one amine with an average $pK_A$ of from 1 to 14, preferably 2 to 13, in particular 5 to 12.

In one embodiment of the invention, the detergent comprises at least one surfactant and at least one amine.

In one embodiment of the invention, the detergent comprises at least one amine and at least one carboxylic acid as are described above, the amine (s) and carboxylic acid(s) being reacted together.

In one embodiment of the invention, the detergent comprises at least one surfactant and at least one reaction product of tetraaminopropylalkylenediamine and at least one of the carboxylic acids described in Claims 4 and 5, preferably terephthalic acid, glutaric acid, succinic acid, adipic acid, citric acid or a mixture thereof, where the alkylene radical has 2–20 carbon atoms and is unsubstituted or substituted.

These detergents may be used according to the invention for cleaning textiles.

Conventional ingredients of the detergents according to the invention include builders, surfactants, bleaches, enzymes and other ingredients as described hereinafter.

Builders

Inorganic builders (A) suitable for combination with the (polyalkylenepoly)amines according to the invention are, in particular, crystalline or amorphous alumosilicates with ion-exchanging properties such as, in particular, zeolites. Various types of zeolites are suitable, in particular zeolites A, X, B, P, MAP and HS in their Na form or in forms in which Na is partly replaced by other cations such as Li, K, Ca, Mg or ammonium. Suitable zeolites are described, for example, in EP-A 038591, EP-A 021491, EP-A 087035, U.S. Pat. No. 4,604,224, GB-A 2013259, EP-A 522726, EP-A 384070 and WO-A 94/24251.

Examples of suitable crystalline silicates (A) are disilicates or sheet silicates, eg. SKS-6 (manufacturer: Hoechst). The silicates can be employed in the form of their alkali metal, alkaline earth metal or ammonium salts, preferably as Na, Li and Mg silicates.

Amorphous silicates such as sodium metasilicate which has a polymeric structure, or Britesil® H20 (manufacturer: Akzo), can likewise be used.

Suitable inorganic carbonate-based builder substances are carbonates and bicarbonates. These can be employed in the form of their alkali metal, alkaline earth metal or ammonium salts, Na, Li and Mg carbonates or bicarbonates, in particular sodium carbonate and/or sodium bicarbonate are preferably employed.

Conventional phosphates as inorganic builders are polyphosphates such as pentasodiumtriphosphate.

Said components (A) can be employed singly or mixed with one another. Of particular interest as inorganic builder component is a mixture of alumosilicates and carbonates, in particular of zeolites, especially zeolite A, and alkali metal carbonates, especially sodium carbonate, in the ratio of from 98:2 to 20:80, in particular from 85:15 to 40:60, by weight. Besides this mixture it is also possible for other components (A) to be present.

In a preferred embodiment, the textile detergent formulation according to the invention comprises from 0.1 to 20% by weight, in particular 1 to 12% by weight, of organic cobuilders (B) in the form of low molecular weight oligomeric or polymeric carboxylic acids, especially polycarboxylic acids, or phosphonic acids or their salts, especially Na or K salts.

Examples of suitable low molecular weight carboxylic acids or phosphonic acids for (B) are:

- $C_4$–$C_{20}$-di-, tri- and -tetracarboxylic acids such as succinic acid, propanetricarboxylic acid, butanetetracarboxylic acid, cyclopentanetetracarboxylic acid and alkyl- and alkenylsuccinic acids with $C_2$–$C_{16}$-alkyl or -alkenyl radicals;
- $C_4$–$C_{20}$-hydroxy carboxylic acids such as malic acid, tartaric acid, gluconic acid, glutaric acid, citric acid, lactobionic acid and sucrosemono-, -di- and -tricarboxylic acids;

amino polycarboxylic acids such as nitrilotriacetic acid, β-alaninediacetic acid, ethylenediaminetetraacetic acid, serinediacetic acid, isoserinediacetic acid, methylglycinediacetic acid and alkylethylenediaminetriacetates;

salts of phosphonic acids such as hydroxyethanediphosphonic acid.

Examples of suitable oligomeric or polymeric carboxylic acids for (B) are:

oligomaleic acids as described, for example in EP-A 451 508 and EP-A 396 303;

co- and terpolymers of unsaturated $C_4$–$C_8$-dicarboxylic acids, possible comonomers being monoethylenically unsaturated monomers from group (i) in amounts of up to 95% by weight, from group (ii) in amounts of up to 60% by weight and from group (iii) in amounts of up to 20% by weight Suitable unsaturated $C_4$–$C_8$-dicarboxylic acids in this case are, for example, maleic acid, fumaric acid, itaconic acid and citraconic acid. Maleic acid is preferred.

Group (i) comprises monoethylenically unsaturated $C_3$–$C_8$-monocarboxylic acids such as acrylic acid, methacrylic acid, crotonic acid and vinylacetic acid. Preferably employed from group (i) are acrylic acid and methacrylic acid.

Group (ii) comprises monoethylenically unsaturated $C_2$–$C_{22}$-olefins, vinyl alkyl ethers with $C_1$–$C_8$-alkyl groups styrene, vinyl esters of $C_1$–$C_8$-carboxylic acids, (meth) acrylamide and vinylpyrrolidone. Preferably employed from group (ii) are $C_2$–$C_6$-olfeins, vinyl alkyl ethers with $C_1$–$C_4$-alkyl groups, vinyl acetate and vinyl propionate.

Group (iii) comprises (meth)acrylic esters of $C_1$–$C_8$-alcohols, (meth)acrylonitrile, (meth)acrylamides of $C_1$–$C_8$-amines, N-vinylformamide and vinylimidazole.

If the polymers contain as monomers of group (ii) vinyl esters, these can also be partially or completely hydrolyzed to vinyl alcohol structural units. Examples of suitable co- and terpolymers are disclosed in U.S. Pat. No. 3,887,806 and DE-A 43 13 909.

Suitable and preferred as copolymers of dicarboxylic acids for component (B) are:

copolymers of maleic acid and acrylic acid in the ratio of from 10:90 to 95:5 by weight, particularly preferably in the ratio of from 30:70 to 90:10 by weight, with molecular weights of from 100,000 to 150,000;

terpolymers of maleic acid, acrylic acid and a vinyl ester of a $C_1$–$C_3$-carboxylic acid in the ratio of from 10 (maleic acid):90 (acrylic acid+vinyl ester) to 95 (maleic acid):10 (acrylic acid+vinyl ester) by weight, it being possible for the ratio of acrylic acid to vinyl ester to vary in the range from 30:70 to 70:30 by weight;

copolymers of maleic acid with $C_2$–$C_8$-olefins in the molar ratio of from 40:60 to 80:20, with copolymers of maleic acid with ethylene, propylene or isobutene in the molar ratio 50:50 being particularly preferred.

Graft copolymers of unsaturated carboxylic acids on low molecular weight carbohydrates or hydrogenated carbohydrates, cf. U.S. Pat. No. 5,227,446, DE-A 44 15 623 and DE-A 43 13 909, are likewise suitable as component (B).

Examples of suitable unsaturated carboxylic acids in this case are maleic acid, fumaric acid, itaconic acid, citric acid, acrylic acid, methacrylic acid, crotonic acid and vinylacetic acid, and mixtures of acrylic acid and maleic acid, which are grafted on in amounts of from 40 to 95% of the weight of the component to be grafted.

It is additionally possible for the polymer to be modified by the presence of up to 30% by weight, based on the component to be grafted, of other monoethylenically unsaturated monomers. Suitable modifying monomers are the monomers of groups (ii) and (iii) mentioned above.

Suitable as grafting base are degraded polysaccharides such as acidically or enzymatically degraded starches, inulins or cellulose, protein hydrolysates and reduced (hydrogenated or reductively aminated) degraded polysaccharides such as mannitol, sorbitol, aminosorbitol and N-alkylglucamine, and polyalkylene glycols with molecular weights of up to $M_w$=5000, such as polyethylene glycols, ethylene oxide/propylene oxide and ethylene oxide/butylene oxide and ethylene oxide/propylene oxide/butylene oxide block copolymers and alkoxylated monohydric or polyhydric $C_1$–$C_{22}$-alcohols, cf. U.S. Pat. No. 5,756,456.

Preferably employed from this group are grafted degraded or degraded reduced starches and grafted polyethylene oxides, employing from 20 to 80% by weight of monomers, based on the grafting component, in the graft copolymerization. A mixture of maleic acid and acrylic acid in the ratio of from 90:10 to 10:90 by weight is preferably employed for grafting.

Polyglyoxylic acids suitable as component (B) are described, for example, in EP-B 001 004, U.S. Pat. No. 5,399,286, DE-A 41 06 355 and EP-A 0 656 914. The end groups of the polyglyoxilic acids may have different structures.

Polyamidocarboxylic acids and modified polyamidocarboxylic acids suitable as component (B) are disclosed, for example, in EP-A 454 126, EP-B 511 037, WO-A 94/01486 and EP-A 581 452.

Particularly used as component (B) are also polyaspartic acids or cocondensates of aspartic acid with other amino acids, $C_4$–$C_{25}$-mono- or -dicarboxylic acids and/or $C_4$–$C_{25}$-mono- or -diamines. Particularly preferably employed are polyaspartic acids prepared in phosphorus-containing acids and modified with $C_6$–$C_{22}$-mono- or dicarboxylic acids or with $C_6$–$C_{22}$-mono- or -diamines.

Condensation products of citric acid with hydroxy carboxylic acids or polyhydroxy compounds suitable as component (B) are disclosed, for example, in WO-A 93/22362 and WO-A 92/16493. Carboxyl-containing condensates of this type normally have molecular weights of up to 10,000, preferably up to 5000.

Furthermore suitable as component (B) are ethylenediaminedisuccinic acid, oxydisuccinic acid, aminopolycarboxylates, aminopolyalkylenephosphonates and polyglutamates.

It is furthermore possible to use, in addition to component (B), oxidized starches as organic cobuilders.

Surfactants

Examples of suitable anionic surfactants (C) are fatty alcohol sulfates of fatty alcohols with from 8 to 22, preferably 10 to 18, carbon atoms, eg. $C_9$–$C_{11}$-alcohol sulfates, $C_{12}$–$C_{14}$-alcohol sulfates, cetyl sulfate, myristyl sulfate, palmityl, sulfate, stearyl sulfate and tallow fatty alcohol sulfate.

Further suitable anionic surfactants are sulfated ethoxylated $C_8$–$C_{22}$-alcohols (alkyl ether sulfates) and their soluble salts. Compounds of this type are prepared, for example, by initially alkoxylating a $C_8$–$C_{22}$-, preferably a $C_{10}$–$C_{18}$-alcohol, eg. a fatty alcohol, and subsequently sulfating the alkoxylation product. Ethylene oxide is preferably used for the alkoxylation, employing from 2 to 50, preferably 3 to 20, mol of ethylene oxide per mole of alcohol. The alkoxylation of the alcohols can, however, also be carried out with propylene oxide alone or together with butylene oxide. Also suitable are alkoxylated $C_8$–$C_{22}$-alcohols which contain ethylene oxide and propylene oxide or ethylene oxide and butylene oxide or ethylene oxide and propylene oxide and butylene oxide. The alkoxylated $C_8$–$C_{22}$-alcohols may contain the ethylene oxide, propylene oxide and butylene oxide units in the form of blocks or in random distribution. Alkyl ether sulfates with a wide or narrow alkylene oxide distribution can be obtained depending on the nature of the alkoxylation catalyst.

Other suitable anionic surfactants are alkanesulfonates such as $C_8$–$C_{24}$-, preferably $C_{10}$–$C_{18}$-, alkanesulfonates, and soaps such as the Na and K salts of $C_8$–$C_{24}$-carboxylic acids.

Further suitable anionic surfactants are linear $C_9$–$C_{20}$-alkylbenzenesulfonates (LAS) and -alkyltoluenesulfonates.

Further suitable anionic surfactants (C) are also $C_8$–$C_{24}$-olefinsulfonates and -disulfonates, which may also be mixtures of alkene- and hydroxyalkanesulfonates and -disulfonates, and alkyl ester sulfonates, sulfonated polycarboxylic acids, alkyl glycerol sulfonates, fatty acid glycerol ester sulfonates, alkylphenol polyglycol ether sulfates, paraffin sulfonates with from about 20 to about 50 carbon atoms (based on paraffin or paraffin mixtures obtained from natural sources), alkyl phosphates, acylisethionates, acryltaurates, acylmethyltaurates, alkylsuccinic acids, alkenylsuccinic acids or their monoesters or monoamides, alkylsulfosuccinic acids or their amides, mono- and diesters of sulfosuccinic acids, acylsarcosinates, sulfated alkyl polyglucosides, alkyl polyglycol carboxylates and hydroxyalkyl sarcosinates.

The anionic surfactants are added to the detergent preferably in the form of salts. Suitable cations in these salts are alkali metal ions such as sodium, potassium and lithium and ammonium ions such as hydroxyethylammonium, di(hydroxyethyl)ammonium and tri(hydroxyethyl) ammonium ions.

Component (C) is preferably present in the textile detergent formulation according to the invention in an amount of from 3 to 30% by weight, in particular 5 to 15% by weight. If linear $C_9$–$C_{20}$-alkylbenzenesulfonates (LAS) are also present, these are normally used in an amount of up to 10% by weight, in particular up to 8% by weight. It is possible to use only one class of anionic surfactants alone, for example only fatty alcohol sulfates or only alkylbenzenesulfonates, but it is also possible to use mixtures of various classes, eg. a mixture of fatty alcohol sulfates and alkylbenzenesulfonates. Mixtures of different species within the individual classes of anionic surfactants can also be employed.

Examples of suitable nonionic surfactants (D) are alkoxylated $C_8$–$C_{22}$-alcohols such as fatty alcohol alkoxylates or oxo alcohol alkoxylates. The alkoxylation can be carried out with ethylene oxide, propylene oxide and/or butylene oxide. Surfactants which can be employed in this case are all alkoxylated alcohols which contain at least two molecules of an abovementioned alkylene oxide in the adduct. Also suitable in this connection are block polymers of ethylene oxides, propylene oxide and/or butylene oxide, or adducts which contain said alkylene oxides in random distribution. From 2 to 50, preferably 3 to 20, mol of at least one alkylene oxide are used per mole of alcohol. Ethylene oxide is preferably employed as alkylene oxide. The alcohols preferably have from 10 to 18 carbon atoms. Alkoxylates with a wide or narrow alkylene oxide distribution can be obtained depending on the nature of the alkoxylation catalyst.

Another class of suitable nonionic surfactants comprises alkylphenol alkoxylates such as alkylphenol ethoxylates with $C_6$–$C_{14}$-alkyl chains and from 5 to 30 mol of alkylene oxide units.

Another class of nonionic surfactants comprises alkyl polyglucosides or hydroxyalkyl polyglucosides with from 8 to 22, preferably 10 to 18, carbon atoms in the alkyl chain. These compounds usually contain from 1 to 20, preferably 1.1 to 5, glucoside units.

Another class of nonionic surfactants comprises N-alkylglucamides with $C_6$–$C_{22}$-alkyl chains. Compounds of this type are obtained, for example, by acylation of reductively aminated sugars with appropriate long-chain carboxylic acid derivatives.

Also suitable as nonionic surfactants (D) are block copolymers of ethylene oxides, propylene oxide and/or butylene oxide (Pluronic and Tetronic brands of BASF), polyhydroxy or polyalkoxy fatty acid derivatives such as polyhydroxy fatty acid amides, polyhydroxy fatty acid N-alkoxy- or N-aryloxyamides, fatty acid amide ethoxylates, especially endgroup-capped, and fatty acid alkanolamide alkoxylates.

Component (D) is preferably present in the textile detergent formulation according to the invention in an amount of from 1 to 20% by weight, in particular 3 to 12% by weight. It is possible to use only one class of nonionic surfactants alone, in particular only alkoxylated $C_8$–$C_{22}$-alcohols, but it is also possible to use mixtures of various classes. Mixtures of different species within the individual classes of nonionic surfactants can also be employed.

Since the balance between said types of surfactants is important for the efficacy of the detergent formulation according to the invention, the ratio by weight of anionic surfactants (C) to nonionic surfactants (D) is preferably from 95:5 to 20:80, in particular from 70:30 to 50:50.

The detergents according to the invention may furthermore contain cationic surfactants (E).

Examples of suitable cationic surfactants are surface-active compounds containing ammonium groups, such as alkyldimethylammonium halides and compounds of the general formula $$RR^1R^2R^3N^+X^-$$

where the radicals R -$R^3$ are alkyl or aryl radicals, alkylalkoxy, arylalkoxy, hydroxyalkyl(alkoxy) or hydroxyaryl(alkoxy) groups and X is a suitable anion.

The detergents according to the invention may also contain ampholytic surfactants (F) such as aliphatic derivatives of secondary or tertiary amines which contain an anionic group in one of the side chains, alkyldimethylamine oxides or alkyl- or alkoxymethylamine oxides.

Components (E) and (F) may comprise up to 25%, preferably 3–15%, of the detergent formulation.

Bleaches

In another preferred embodiment, the textile detergent formulation according to the invention additionally comprises from 0.5 to 30% by weight, in particular 5 to 27% by weight, especially 10 to 23% by weight, of bleach (G). Examples are alkali metal perborates or alkali metal carbonate perhydrates, especially the sodium salts.

An example of an organic peracid which can be used is peracetic acid, which is preferably used in commercial textile laundering or commercial cleaning.

Bleach or textile detergent compositions which can advantageously be used contain $C_{1-12}$-percarboxylic acids, $C_{8-16}$-dipercarboxylic acids, imidopercaproic acids or aryldipercaproic acids. Preferred examples of acids which can be used are peracetic acid, linear or branched peroctanoic, -nonanoic, -decanoic or -dodecanoic acids, diperdecane- and -dodecanedioic acids, mono- and diperphthalic acids, -isophthalic acids and -terephthalic acids, phthalimidopercaproic acid and terephthaloyldipercaproic acid. It is likewise possible to use polymeric peracids, for example those containing acrylic acid basic building blocks in which a peroxy functionality is present. The percarboxylic acids can be used as free acids or as salts of the acids, preferably alkali metal or alkaline earth metal salts. These bleaches (G) are used, where appropriate, in combination with from 0 to 15% by weight, preferably 0.1 to 15% by weight, in particular 0.5 to 8% by weight, of bleach activators (H). In the case of color detergents, the bleach (G) (if present) is, as a rule, employed without bleach activator (H), otherwise bleach activators (H) are normally present.

Suitable bleach activators (H) are:

polyacrylated sugars, eg. pentaacetylglucose;

acyloxybenzenesulfonic acids and their alkali metal and alkaline earth metal salts, eg. sodium p-isononanoyloxybenzenesulfonate or sodium p-benzoyloxybenzenesulfonate;

N,N-diacylated and N,N,N',N'-tetraacylated amines, eg. N,N,N',N'-tetraacetylmethylenediamine and -ethylenediamine (TAED), N,N-diacetylaniline, N,N-diacetyl-p-toluidine or 1,3-diacylated hydantoins such as 1,3-diacetyl-5,5-dimethylhydantoin;

N-alkyl-N-sulfonylcarboxamides, eg. N-methyl-N-mesylacetamide or N-methyl-N-mesylbenzamide;

N-acylated cyclic hydrazides, acrylated triazoles or urazols, eg. monoacetylated maleic hydrazide;

O,N,N-trisubstituted hydroxylamines, eg. O-benzoyl-N,N-succinylhydroxylamine, O-acetyl-N,N-succinylhydroxylamine or O,N,N-triacetylhydroxylamine;

N,N'-diacylsulfamides, eg. N,N'-dimethyl-N,N'-diacetylsulfamide or N,N'-diethyl-N,N'-dipropionylsulfamide;

triacylcyanurates, eg. triacetylcyanurate or tribenzoylcyanurate;

carboxylic anhydrides, eg. benzoic anhydride, m-chlorobenzoic anhydride or phthalic anhydride;

1,3-diacyl-4,5-diacyloxyimidazolines, eg. 1,3-diacetyl-4,5-diacetoxyimidazoline;

tetraacetylglycoluril and tetrapropionylglycoluril;

diacylated 2,5-diketopiperazines, eg. 1,4-diacetyl-2,5-diketopiperazine;

acylation products of propylenediurea and 2,2-dimethylpropylenediurea, eg. tetraacetylpropylenediurea;

α-acyloxypolyacylmalonamides, eg. α-acetoxy-N,N'-diacetylmalonamide;

diacyldioxohexahydro-1,3,5-triazines, eg. 1,5-diacetyl-2,4-dioxohexahy-dro-1,3,5-triazine;

benz-(4H)1,3-oxazin-4-ones with alkyl radicals eg. methyl, or aromatic radicals, eg. phenyl, in position 2.

The described bleaching system comprising bleaches and bleach activators may also contain bleach catalysts. Examples of suitable bleach catalysts are quaternized imines and sulfone imines which are described, for example, in U.S. Pat. No. 5,360,569 and EP-A 453 003. Particularly effective bleach catalysts are manganese complexes which are described, for example, in WO-A94/21777. When such compounds are employed in detergent formulations they are incorporated in amounts not exceeding 1.5% by weight, in particular up to 0.5% by weight. Bleach catalysts which are likewise suitable are the amines described in the application filed at the same time as this application and entitled "Bleaching efficiency boosters for bleach and textile detergent compositions".

Besides the described bleaching system comprising bleaches and bleach activators, with or without bleach catalysts, it is also conceivable that systems with enzymatic liberation of peroxide or photoactivated bleach systems could be used for the textile detergent formulation according to the invention.

Enzymes

In another preferred embodiment, the textile detergent formulation according to the invention additionally contains from 0.05 to 4% by weight of enzymes (J). Enzymes preferably employed in detergents are proteases, amylases, lipases and cellulases. The amounts of the enzymes added are preferably 0.1–1.5% by weight, in particular preferably 0.2–1.0% by weight, of the formulated enzyme. Example of suitable proteases are Savinase and Esperase (manufacturer: Novo Nordisk). An example of a uitable lipase is Lipolase (manufacturer: Novo Nordisk). An example of a suitable cellulase is Celluzym (manufacturer: Novo Nordisk). It is also possible to use peroxidases to activate the bleaching system. Single enzymes or a combination of different enzymes can be employed. The textile detergent formulation according to the invention may also contain enzyme stabilizers, eg. calcium propionate, sodium formate or boric acids or salts thereof, and/or oxidation inhibitors.

Other Ingredients

The textile detergent formulations according to the invention may also, besides the main components (A) to (J) mentioned, contain the following further conventional additives in the amounts customary therefor:

antiredeposition agents and soil release polymers

Suitable soil release polymers and/or antiredeposition agents for detergents are, for example:

polyesters from polyethylene oxides with ethylene glycol and/or propylene glycol and aromatic dicarboxylic acids or aromatic and aliphatic dicarboxylic acids; polyesters from polyethylene oxides, which are endgroup-capped at one end, with dihydric and/or polyhydric alcohols and dicarboxylic acid.

Polyesters of this type are disclosed, for example, in U.S. Pat. No. 3,557,039, GB-A 1 154 730, EP-A-185 427, EP-A-241 984, EP-A-241 985, EP-A-272 033 and U.S. Pat. No. 5,142,020.

Further suitable soil release polymers are amphiphilic graft or other copolymers of vinyl and/or acrylic esters on polyalkylene oxides (cf. U.S. Pat. No. 4,746,456, U.S. Pat. No. 4,846,995, DE-A-37 11 299, U.S. Pat. No. 4,904,408, U.S. Pat. No. 4,846,994 and U.S. Pat. No. 4,849,126) or modifed cellulose such as methylcellulose, hydroxypropylcellulose or carboxymethylcellulose.

Color transfer inhibitors, for example homo- or copolymers of vinylpyrrolidone, of vinylimidazole, of vinyloxazolidone or of 4-vinylpyridine N-oxide with molecular weights of from 15,000 to 100,000, and crosslinked fine-particle polymers based on these monomers;

nonsurfactant foam producers or foam inhibitors, for example organo-polysiloxanes and mixtures thereof with microfine, preferably silanized silica and paraffins, waxes, microcrystalline waxes and mixtures thereof with silanized silica;

complexing agents (also functioning as organic cobuilders);

optical brighteners;

polyethylene glycols;
perfumes or fragrances;
bulking agents;
inorganic fillers, eg. sodium sulfate;
formulation aids;
solubility improvers;
opacifying and periescent agents;
dyes;
corrosion inhibitors;
peroxide stabilizers;
electrolytes.

The detergent formulation according to the invention is solid, ie. it is normally in the form of powders or granules or in the form of extrudates or tablets.

The powder or granular detergents according to the invention may contain up to 60% by weight of inorganic fillers. Sodium sulfate is normally used for this purpose. However, the detergents according to the invention preferably have a low filler content of only up to 20% by weight, particularly preferably only up to 8% by weight of fillers, especially for compact or ultracompact detergents. The solid detergents according to the invention may have apparent densities varying in the range from 300 to 1300 g/l, in particular from 550 to 1200 g/l. As a rule, modern compact detergents have high apparant densities and a granular structure. Conventional processes can be employed for the required compaction of the detergents.

The detergent formulation according to the invention is produced and, where appropriate, packed by conventional methods.

Typical compositions of compact heavy duty detergents and color detergents are indicated below (percentage data hereinafter and in the examples relate to weight; the data in parentheses for compositions (a) and (b) are preferred ranges):

(a) Composition of Compact Heavy Duty Detergents (powder or granular)

1–60% (8–30%) of at least one anionic (C) and one nonionic surfactant (D)
5–50% (10–45%) of at least one inorganic builder (A)
0.1–20% (0.5–15%) of at least one organic cobuilder (B)
5–30% (10–25%) of an inorganic bleach (G)
0.1–15% (1–8%) of a bleach activator (G)
0–1% (max. 0.5%) of a bleach catalyst
0.05–5% (0.2–2.5%) of a color transfer inhibitor
0.3–1.5% of a soil release polymer
0.1–4% (0.2–2%) of enzyme or enzyme mixture (H)
Other Conventional Additives:
sodium sulfate, complexing agents, phosphonates, optical brighteners, perfume oils, foam reducers, antiredeposition agents, bleach stabilizers (b) Composition of Color Detergents (powder or granular)

3–50% (8–30%) of at least one anionic (C) and one nonionic surfactant (D)
10–60% (20–55%) of at least one inorganic builder (A)
0–15% (0–5%) of an inorganic bleach (G)
0.5–5% (0.2–2.5%) of a color transfer inhibitor
0.1–20% (1–8%) of at least one organic cobuilder (B)
0.2–2% of enzyme or enzyme mixture (J)
0.2–1.5% of soil release polymer
Other Conventional Additives:
sodium sulfate, complexing agents, phosphonates, optical brighteners, perfume oils, foam reducers, antiredeposition agents, bleach stabilizers.

The amines or salts or reaction products with carboxylic acids according to the invention are present in detergents according to the invention in amounts of from 0.1 to 5% by weight, preferably 0.2 to 4% by weight, in particular 0.5 to 2.5% by weight. The amounts in compact heavy duty detergents (powder or granular) are from 0.1 to 5% by weight (0.2 to 4.5% by weight), preferably 0.4 to 3% by weight (0.5 to 2.5% by weight).

The invention is illustrated in detail by means of the following examples.

EXAMPLES

Example 1

N,N,N',N'-Tetraaminopropyl-1,2-ethylenediamine (N6-amine)

Preparation of N,N,N', N'-tetracyanoethyl-1,2-ethylenediamine: 443 g (8.35 mol) of acrylonitrile are added over the course of 90 minutes to a solution of 100 g (1.67 mol) of 1,2-ethylenediamine in 1176 ml of water. The temperature must not exceed 40° C. during this. After addition of the acrylonitrile is complete, the flask is stirred at 40° C. for one hour and at 80° C. for two further hours.

Excess acrylonitrile is subsequently removed by distillation and then most of the water is distilled out under a water pump or oil pump vacuum. The tetracyanoethylated ethylenediamine is recrystallized from methanol and filtered off with suction. The yield is 478 g. (1.58 mol).

Preparation of N,N,N', N'-tetraaminopropyl-1,2-ethylenediamine (N6-amine): 400 ml/h of a mixture of 20% by weight of N,N,N',N'-tetracyanoethyl-1,2-ethylenediamine and 80% by weight of N-methylpyrrolidone and 3500 ml/h ammonia are passed at 130° C. under a hydrogen pressure of 200 bar over 41 of a fixed bed catalyst composed of 90% by weight of CoO, 5% by weight of MnO and 5% by weight of $P_2O_5$ in a 51 fixed bed reactor. Removal of the N-methyl-pyrrolidone under reduced pressure and fractional distillation (boiling point: 218° C. under 6 mbar) result in N,N,N',N'-tetraaaminopropyl-1,2-ethylenediamine (N6-amine) in 95% yield. The product was checked for purity and completeness of reaction by $^{13}C$ and $^{1}H$ NMR and mass spectroscopy.

Example 2

1:1 N6-amine/succinic Acid Reaction Product 3.7 g (0.0125 mol) of N6-amine (from Example 1) and 1.5 g (0.0125 mol) of succinic acid are refluxed in 10.4 g of dioxane at a bath temperature of 140° C. for 2 h. The dioxane is distilled off for azeotropic removal of the water of reacton. The azcotropic removal of the water of reaction is then continued by adding 13 g portions of dioxane four times and likewise removing by distillation. After the last distillation, the mixture is diluted with deionized water and the remaining dioxane is removed by steam distillation. The resulting solution has a solids content of 5.2%.

Example 3

1:1 N6-amine and Sokalan® DCS Reaction Product

Preparation takes place as in Example 2 using 3.7 g (0.0125 mol) of N6-amine, 1.7 g of Sokalan® DCS (equivalent on average to 0.0125 mol of a mixture of succinic acid, glutaric acid and adipic acid). 13 g of dioxane are used as solvent. A solution with a solids content of 7.3% is obtained.

Example 4

Polyethyleneimine

Polyethyleneimine was prepared from ethyleneimine with an EDA/$H_2SO_4$ catalyst. As catalyst solution 80 g (1.33 mol) of ethylenediamine and 65.3 g (0.67 mol) of concentrated $H_2SO_4$ were introduced into 260 g of deionized water. At 90° C., a 60% strength ethyleneimine solution consisting of 344 g (8 mol) of ethyleneimine and 229 g of ice was added dropwise. The mixture was then stirred at 90° C. until the Preuβmann test for alkylating substances was negative. The Preuβmann test was carried out as described in J. Epstein et al., Analyst. Chem. 27 (1955) 1435 and R. Preuβmann et al., Arzneimittelforsch. 19 (1969) 1059.

Example 5

Anhydrous Polyethyleneimine 6.0 g (0.1 mol) of ethylenediamine, 2.2 g (0.05 mol) of $CO_2$ and 17 g of deionized water were mixed as catalyst solution. At 90° C., 60% strength ethyleneimine solution composed of 43 g (1 mol) of ethyleneimine and 29 g of ice was added dropwise to the mixture. The mixture was then stirred at 90° C. until the Preuβmann test for alkylating substances was negative.

Example 6

Anhydrous Polyethyleneimine 3.0 g (0.05 mol) of ethylenediamine, 1.1 g (0.025 mol) of $CO_2$ and 17 g of deionized water were mixed as catalyst solution. At 90° C., 60% strength ethyleneimine solution composed of 43 g (1 mol) of ethyleneimine and 29 g of ice was added dropwise to the mixture. The mixture was then stirred at 90° C. until the Preuβmann test for alkylating substances was negative.

Example 7

20:1 Amidation of Anhydrous Polyethyleneimine with Benzoic Acid 183.18 g of benzoic acid (1.5 mol) were introduced in portions into 1290 g of polyethyleneimine from Example 5 under nitrogen at 140° C. The mixture was then stirred at 180° C. until the acid number was less than 5% of the initial value.

Example 8

Condensation of Anhydrous Polyethyleneimine with Sokalan DCS®

68.6 g (0.5 mol) of Sokalan DCS® were metered in portions into 645 g of polyethyleneimine from Example 5 under nitrogen at 140° C. The mixture was then stirred at 180° C. for 26 hours.

Washing Tests

The detergency boosting effect of the amines according to the invention (single wash cycle performance) was determined in washing tests in a Launder-Meter under standardized conditions. The following detergent formulations A and B whose composition is indicated in Table 1 were employed. It is likewise possible according to the invention to use detergent formulations C–M.

Detergent formulations A and B were initially investigated without a detergency booster according to the invention and subsequently investigated with the detergency boosters according to the invention from Examples 1 to 8 in concentrations of 1 or 2% of the total weight of detergent.

Detergent formulations A and B with/without these additives were used to prewash cotton BW221, polyester PES850 and blended cotton/polyester fabric MG 768 as test fabrics under the washing conditions stated below. They were then dried and soiled with 0.2 g of used engine oil. The soiled test fabrics were left to age for 14 hours. The test fabrics were then washed again with detergent formulations A and B with/without the additives, and the single wash cycle performance was determined.

To do this, the reflectance was determined for the soiled test fabrics before washing (R before) and after washing (R after) using a Datacolor photometer (Elrepho®2000).

Washing Conditions:

Machine: Launder-O-Meter from Atlas, Chicago

Wash liquor: 250 ml

Washing time: 30 min at 60° C.

Detergent dose: 6 g/l

Water hardness: 3 mmol; Ca: Mg 4:1

Liquor ratio: 1:12.5

Test fabrics: BW221, PES850, MG 768

Washing Result

To assess the washing result, the reflectance of the test fabric was determined before soiling (R zero), after soiling and before washing (R before) and after washing (R after). The ratio of R after/R zero was then determined and multiplied by 100. A higher value for this percentage indicates better removal of the spots. On complete removal of the spot, R after/R zero×100=100%.

Furthermore, the difference in removal of the spot between detergent formulations without and with the detergency booster according to the invention was determined. To do this, the difference between R after and R before, ie, delta R=R after minus R before, was determined, in particular for the detergent formulation without detergency booster according to the invention as delta R without and with detergency booster according to the invention as delta R with.

A higher difference delta (delta R)=delta R with minus delta R without indicates a greater detergency boosting effect of the added detergency booster according to the invention.

Besides the detergency boosters according to the invention of Examples 1 to 8, I and II (I=reaction product of N-coconut fatty-1,3-diaminopropane with 4 mol of EO (ethylene oxide), II=reaction product of N-tallow fatty-1,3-diaminopropane with 4.5 mol of EO) as described in EP-A-042 187 were used in two comparative examples.

It is evident from Tables 2 and 3 that the detergency boosters according to the invention of Examples 1–8 distinctly improve the single wash cycle performance of detergent formulations A and B, especially for cotton fabrics.

These compounds are likewise effective in other modern compact detergent formulations as listed in Table 1, for other types of soil such as lipstick or makeup, or on other test fabrics such as polyester fabrics or polyester-containing blended fabrics.

TABLE 1

| Ingredients | Composition of the detergent formulations | | | | | | | | | | | |
|---|---|---|---|---|---|---|---|---|---|---|---|---|
| | Composition | | | | | | | | | | | |
| | A | B | C | D | E | F | G | H | I | K | L | M |
| Linear $C_{12}$-alkylbenzenesulfonate (Na salt) | 9 | | 11 | 11 | 11 | | | | | | | |
| $C_{12}$-$C_{18}$-Alkyl sulfate | | 9 | 1 | 1 | | 8 | 8 | 10 | 10 | 10 | | 8 |
| $C_{12}$-Fatty alcohol × 2EO sulfate | | | | | | | | | | | | 2 |
| Oleoylsarcosine Na salt | | | | | | | | | | | 9 | |
| $C_{12}$-$C_{18}$-Fatty alcohol × 4EO | | | | | | | | | | | | 3 |
| $C_{12}$-$C_{18}$-Fatty alcohol × 7EO | | 7 | | | | 7 | 7 | | | | | |
| $C_{13}$-$C_{15}$-Oxoalcohol × 7EO | 7 | | 6 | 6 | 6 | | | | | | 8 | |
| $C_{16}$-$C_{18}$-Glucamide | | | | | | | | | | | | 4 |
| $C_{12}$-$C_{14}$-Alkylpolyglucoside | | | | | | | | 9 | 9 | | | |
| $C_8$-$C_8$-Fatty acid methyltetraglycolamide | | | | | | | | | | 9 | | |
| Soap | 2 | 2 | 2 | 2 | 2 | 1 | 1 | 1 | 1 | 1 | 1 | 2 |
| Na metasilicate × 5.5 $H_2O$ | | | | | | | | 3 | 3 | 3 | 3 | |
| Mg silicate | 1 | 1 | | | | | | | | | | |
| Na silicate | | | 2 | 2 | 2 | 3 | 3 | | | | | |
| Zeolite A | 45 | 45 | 40 | 40 | 40 | 36 | 20 | 30 | 30 | 30 | 30 | 20 |
| Zeolite P | | | | | | | 10 | | | | | |
| Sheet silicate SKS6 | | | | | | | | | | | | 15 |
| Sodium carbonate | 7 | 7 | 6 | 6 | 6 | 12 | 10 | 8 | 8 | 8 | | |
| Sodium citrate | 12 | 12 | | | | 5 | | | | | | 5 |
| Sodium citrate × 2 $H_2O$ | | | 18 | 18 | 18 | | | | | | | |
| MGDA tri-Na | | | | | | | 5 | 5 | 5 | | | |
| Phosphonate | | | | 1 | | | | | | 1 | 2 | |
| TAED | | | | | | 4 | 4 | 4 | 4 | 4 | 4 | 5 |
| Sodium perborate × 4 $H_2O$ | | | | | | | | | 20 | | | |
| Sodium perborate × 1 $H_2O$ | | | | | | | | 14.4 | | 14.4 | 14.4 | |
| Sodium percarbonate | | | | | | 15 | 15 | | | | | 15 |
| Carboxymethylcellulose | 1 | 1 | 1 | 1 | 1 | 1.5 | 1 | 1.2 | 1.2 | 1.2 | 1.2 | 1 |
| Lipase | 0.2 | 0.2 | | | 0.2 | 0.2 | 0.2 | 0.2 | 0.2 | 0.2 | 0.2 | 0.2 |
| Protease | 0.3 | 0.3 | | | 0.3 | 0.3 | 0.3 | 0.3 | 0.3 | 0.3 | 0.3 | 0.3 |
| Cellulase | 0.5 | 0.5 | | | 0.5 | 0.5 | 0.5 | 0.5 | 0.5 | 0.5 | 0.5 | 0.5 |
| Sodium sulfate | 3 | 3 | 3 | 3 | 3 | 3 | 3 | 3 | 3 | 3 | 3 | 3 |
| Polymer (AA/MA copolymer) | 5 | 5 | 5 | 5 | 5 | 3 | 5 | 5 | 5 | 5 | 5 | 5 |
| Soil release polymer | 1 | 1 | | 1 | 1 | 0.5 | 0.5 | 0.5 | 0.5 | 0.5 | 0.5 | 0.5 |
| Color transfer inhibitor | 1.5 | | 1 | 1 | 1 | 0.5 | | | | | | |
| Water | ad 100 | ad 100 | ad 100 | ad 100 | ad 100 | ad 100 | ad 100 | ad 100 | ad 100 | ad 100 | ad 100 | ad 100 |

TABLE 2

Results of the washing tests
Detergent A, with 1% of the stated detergency booster added
Test fabric: cotton BW 221

| Detergency booster | R before | R after | R after/ R before | delta R | delta (delta R) |
|---|---|---|---|---|---|
| Example 1 | 23.1 | 66.6 | 78.7% | 43.5 | 13.5 |
| Example 2 | 23.0 | 67.9 | 80.9% | 34.9 | 2.4 |
| Example 3 | 23.0 | 63.6 | 75.8% | 40.6 | 7.1 |
| Example 4 | 23.0 | 57.2 | 68.2% | 34.2 | 4.4 |
| Comparative Example I (EP 42 187) | 23.1 | 55.5 | 66.2% | 32.4 | −4.0 |
| Comparative Example II (EP 42 187) | 23.7 | 56.3 | 67.1% | 32.6 | −3.8 |

TABLE 3

Results of the washing tests
Detergent B, with 2% of the stated detergency booster added
Test fabric: cotton BW 221

| Detergency booster | R before | R after | R after/ R before | delta R | delta (delta R) |
|---|---|---|---|---|---|
| Example 1 | 24.4 | 70.7 | 84.3% | 46.3 | 16.6 |
| Example 2 | 23.1 | 73.4 | 87.5% | 50.3 | 14.8 |

TABLE 3-continued

Results of the washing tests
Detergent B, with 2% of the stated detergency booster added
Test fabric: cotton BW 221

| Detergency booster | R before | R after | R after/ R before | delta R | delta (delta R) |
|---|---|---|---|---|---|
| Example 3 | 23.0 | 75.7 | 90.2% | 52.7 | 17.3 |
| Example 4 | 24.3 | 64.3 | 76.6% | 40.0 | 10.3 |
| Example 6 | 24.3 | 66.4 | 79.1% | 42.1 | 12.4 |
| Example 7 | 23.6 | 71.4 | 85.1% | 47.8 | 14.6 |
| Example 8 | 21.0 | 67.6 | 83.6% | 46.6 | 8.5 |

We claim:

1. A method of boosting detergency of a detergent, which comprises:

(a) admixing one or more amines with an average $pK_A$ of from 1 to 14 to the detergent, containing at least one surfactant, wherein the one or more amines have the formula (I):

$$RR'N\text{-}(\text{-}(CR^1R^2)_x\text{-}NR^3\text{-})_a\text{-}((CR^4R^5)_y\text{-}NR^6\text{-})_b\text{-}R'' \quad (I)$$

wherein R, R', R", $R^1$, $R^2$, $R^4$, $R^5$, are, independently of each other, linear or branched-chain $C_{1-20}$ alkyl, (alkyl)carbonyl or alkylamino, $C_{2-20}$ alkenyl or $C_{6-20}$ aryl, aryloxy, hydroxyaryl, arylcarboxy or arylamino;

$R^3$ and $R^6$ are, independently of each other, hydrogen, linear or branched-chain $C_{1-20}$ alkyl, $C_{6-20}$ aryl, which optionally substituted, or $((CR^7R^8)_z\text{-}NR^9)_c\text{-}R^{10}$, wherein $R^7$, $R^8$, $R^9$ and $R^{10}$ are, independently of each other, as defined for R, R', R", $R^1$, $R^2$, $R^4$, $R^5$; and x, y and z have independently of each other, a value of 2, 3 or 4; and a, b and c have, independently of each other, an integral value value of 0–300, with the exception of mono- and diamines, and wherein polyethyleneimines are optionally rendered hydrophobic by partial modification with benzoic acid; and b) contacting a fabric with the detergent in an amount and for a time sufficient to remove soil from the fabric.

2. The method of claim 1, wherein the fabric is a cotton or cotton-containing blended fabric.

3. The method of claim 1, wherein the fabric is stained with a combination of fatty or oily and pigmented or particulate constituents.

4. The method of claim 1, wherein said detergent is a color textile detergent.

5. The method of claim 3, wherein the fabric is stained with engine oil, lipstick, makeup, shoe cream or clay/oil mixture.

6. The method of claim 1, wherein said one or more amines have a number average molecular weight of from 80 to 150,000.

7. The method of claim 6, wherein said one or more amines have a number average molecular weight of from 110 to 10,000.

8. The method of claim 7, wherein said one or more amines have a number average molecular weight of from 129 to 5,000.

9. The method of claim 8, wherein said one or more amines have a number average molecular weight of up to about 2,500.

10. The method of claim 1, wherein said one or more amines have the formula:

$$RR'N\text{-}(\text{-}(CH_2)_m\text{-}NR'')_x\text{-}R'''$$

wherein:

R, R' and R" are each, independently of one another, $C_{1-20}$ alkyl, $C_{2-20}$ alkenyl or $C_{6-20}$ aryl;

R'" is $\text{-}(CH_2)_o\text{-}(NH\text{-}(CH_2)_m\text{-})_p\text{-}NH_2$, hydroxyalkyl or alkoxy;

x has an integral value of 1–10;

m has an integral value of 2–4;

o has an integral value of 2–4; and p has an integral value of 0–10.

11. The method of claim 1, wherein the detergent comprises at least one di-, tri-, oligo- or polycarboxylic acid or an alkali metal salt, alkaline earth metal salt or ammonium salt thereof or a combination thereof.

12. The method of claim 11, wherein said at least one or more amines are used as reaction products with said carboxylic acid or salt thereof.

13. The method of claim 11, wherein said detergent further comprises builders surfactants, bleaches or enzymes.

14. The method of claim 13, wherein the detergent further comprises color transfer inhibitors, foam producers or inhibitors, complexing agents, optical brighteners, polyethylene glycols, fragrances, solubility improvers, dyes, opacifying or perlescent substances, corrosion inhibitors, peroxide stabilizers or electrolytes.

15. The method of claim 1, wherein said one or more amines have a $pK_A$ of from 2 to 13.

16. The method of claim 1, wherein said one or more amines have a $pK_A$ of from 5 to 12.5.

17. A method of boosting detergency of a detergent, which comprises:

a) admixing one or more amines having the formula:

$$RR'N\text{-}(\text{-}(CH_2)_m\text{-}NH)_x\text{-}H$$

to the detergent, containing at least one surfactant, wherein:

R and R' are each, independently of each other, $C_{1-20}$ alkyl, $C_{2-20}$ alkenyl or $C_{6-20}$ aryl;

m has a value of 2, 3 or 4; and x has an integral value of 1–10; and b) contacting a fabric with the detergent in an amount and for a time sufficient to remove soil from the fabric.

18. A method of boosting detergency of a detergent, which comprises:

a) admixing one or more amines having the formula:

$$H_2N\text{-}(CH_2)_4\text{-}NR\text{-}(CH_2)_4\text{-}NH_2$$

to the detergent, containing at least one surfactant, wherein:

R is hydrogen or $C_{1-20}$, $C_{2-20}$ alkenyl or $C_{6-20}$ aryl; and b) contacting a fabric with the detergent in an amount and for a time sufficient to remove soil from the fabric.

19. A method of boosting detergency of a detergent, which comprises:

a) admixing one or more amines comprising N-alkyl-N-aminopropylamine, N,N-dialkylaminopropylamine or N,N'-bisaminopropylalkylene diamine, to the detergent, containing at least one surfactant; and b) contacting a fabric with the detergent in an amount and for a time sufficient to remove soil from the fabric.

20. The method of claim 19, wherein said N-alkyl-N-aminopropylamine is N-coconut fatty alkyl-N-aminopropylamine.

21. The method of claim 19, wherein said N,N-dialkylaminopropylamine is N,N-dibutylaminopropylamine.

22. The method of claim 19, wherein said N,N-bisaminopropylalkylenediamine comprises N,N'-bisaminopropyl-1,6-hexamethylenediamine or N,N'-bisaminopropyl-1,8-octaethylenediamine.

* * * * *